US006487753B1

(12) United States Patent
Lönnberg

(10) Patent No.: US 6,487,753 B1
(45) Date of Patent: Dec. 3, 2002

(54) ARRANGEMENT FOR PIVOTABLE AND SLIDABLE SUSPENSION OF SHEETS

(76) Inventor: Benth Lönnberg, Drottninggatan 118, 252 22 Helsingborg (SE)

( * ) Notice: Subject to any disclaimer, the term of this patent is extended or adjusted under 35 U.S.C. 154(b) by 0 days.

(21) Appl. No.: 09/654,457

(22) Filed: Aug. 31, 2000

Related U.S. Application Data

(63) Continuation of application No. PCT/SE99/00315, filed on Mar. 4, 1999.

(30) Foreign Application Priority Data

Mar. 4, 1998 (SE) ..... 9800672

(51) Int. Cl.[7] ..... E05D 15/00
(52) U.S. Cl. ..... 16/87.8; 16/87.6 R; 104/94
(58) Field of Search ..... 16/87.8, 87.6 R, 16/88, 89, 90, 91, 98; 104/94, 93, 92, 137, 242, 243, 245; 105/150, 154, 156; 49/425, 409, 411

(56) References Cited

U.S. PATENT DOCUMENTS

| | | | | | |
|---|---|---|---|---|---|
| 3,879,799 A | * | 4/1975 | Williams | 16/89 |
| 4,080,686 A | * | 3/1978 | Hagen | 49/409 |
| 4,141,106 A | * | 2/1979 | Dixon | 16/89 |
| 4,159,556 A | * | 7/1979 | Dickson | 16/87.4 R |
| 4,401,033 A | * | 8/1983 | Gerken | 104/94 |
| 4,845,806 A | | 7/1989 | Hamacher | |
| 5,406,676 A | * | 4/1995 | Williams | 16/87 R |

FOREIGN PATENT DOCUMENTS

| | | | |
|---|---|---|---|
| CH | A451468 | 5/1968 | |
| DE | 4239714 A * | 11/1992 | 16/87 R |
| GB | A445074 | 4/1936 | |
| SE | B427683 | 4/1983 | |
| WO | A1-9217673 | 10/1992 | |
| WO | A1-9308355 | 4/1993 | |
| WO | A1-9409238 | 4/1994 | |

* cited by examiner

*Primary Examiner*—Anthony Knight
*Assistant Examiner*—Mark Williams
(74) *Attorney, Agent, or Firm*—Birch, Stewart, Kolasch & Birch, LLP

(57) ABSTRACT

A device for pivotable and slidable suspension of sheets, such as window-panes for glazed verandas or balconies. The device has an upper and a lower rail, which are arranged in parallel with each other. The rails have transversely of their longitudinal direction a hollow section with a longitudinal slot on the side facing the other rail. On each of the sheets, an upper and a lower fixing element are arranged, which via the slots engage the rails. The lower fixing element has in its lowermost portion a spherical part which rests against a sliding surface in the lower rail section to enable both a sliding and a pivoting motion. Both the upper and the lower fixing element are cylindrical in the portion which extends through the slot in each rail.

19 Claims, 4 Drawing Sheets

ARRANGEMENT FOR PIVOTABLE AND SLIDABLE SUSPENSION OF SHEETS

This application is a continuation of PCT/SE99/00315 filed Mar. 4, 1999.

FIELD OF THE INVENTION

The present invention relates to a device for pivotable and slidable suspension of sheets, such as a window-panes for glazed verandas or balconies.

BACKGROUND ART

A device of the type stated by way of introduction is known from Patent Specification WO 94/09238, in which a sliding element system with guide wheels at the upper rail and a supporting wheel at the lower rail is disclosed. For the lower wheel to follow the correct path, a groove is formed in the lower rail. The forming of the lower wheel with a rounded running tread which abuts against the edges of the groove results in the wheel turning relative to the groove when pivoting the sliding element, which causes the wheel to rise. This motion is used to let a pin adjacent to the upper wheel enter a hole in the upper rail. When the pin is positioned in the hole and the lower wheel is positioned transversely in the rail, these two elements are locked in relation to the longitudinal direction of the rails and, thus, the sliding element cannot tilt when in the open position. Since the wheel should be oriented in the direction of motion when the sliding element is to be moved, this construction does not allow the sliding element to be passed round a corner. Should its direction of motion be changed, it is necessary for the rail to be bent with a large radius. The above publication discloses that the sliding elements can be passed round a corner, but in that case the lower wheels are not fixed in their position relative to the sliding element, which results in the above-mentioned locking function being lost. In order to realise this constructional idea, a large number of components are necessary and this makes the solution expensive.

U.S. Pat. No. 4,845,806 discloses a further variant of how it would be possible to suspend window-panes or sliding elements. In this construction there is only an upper rail, in which carrying elements holding the sliding element can move. There are two carrying elements for each sliding element, one in each of the two upper corners. Each carrying element has two wheels which have vertical axes of rotation and are mounted in a vertically spaced-apart relationship and run in two grooves in the rail to prevent the sliding element from tilting about the longitudinal direction of the rail. To hold the weight of the sliding element, there is a horizontal running surface in the rail section, on which at least one ball castor included in the carrying elements moves. Sliding elements suspended in this manner cannot be opened by a turning motion about one of the carrying elements and can only be pushed along the rail.

There are a number of variants of these two systems, but the differences reside in how many wheels are positioned in the various fixing elements and how the various wheels are positioned relative to each other (see WO 92/17673 and WO 93/08355). These variants comprise a large number of components. They also require narrow tolerances in connection with the mounting of the rails to function in a satisfactory manner.

SUMMARY OF THE INVENTION

An object of the invention is to provide a suspension device which is designed in a simple and robust fashion. It should also be possible for the suspended sheets to be passed round a corner having an arbitrary angle. Combining flexibility and tolerance towards incorrect mounting with stability is also a problem that should be solved.

With a device according to the present invention, a number of advantages over the current technique are achieved.

A spherical bearing which carries the weight of the sheet results in possible directions of sliding not being limited in any way. The cylindrical portions included in the fixing elements and extending through the slots in each rail have the same Possibility of sliding motions as the spherical bearing. By adapting the diameters of the cylindrical portions to the width of the slots, it is possible to adjust the flexibility in the fixing elements. Since the cylindrical portions extend in the vertical direction, a relative vertical motion between rail and fixing element is allowed. With a thin wall of the section of the rail on that side where the slot is cut, the cylindrical portions can be inclined to a considerable extent although there is a small difference in diameter and width (and, thus, good stability).

By arranging a ball castor at the very bottom, the sheet can be passed round corners having an arbitrary angle and it can also be moved more easily along the rails. Such an arrangement also causes less wear on fixing element as well as rail.

If the fixing elements are formed to have an elongate cross-section over part of their length, which part is adapted to follow a groove in the rails, an automatic locking function is achieved if holes are formed along the centre line of the groove which have a diameter exceeding the width of the groove since the elongate cross-sectional portion is then turned tQ be locked in these holes when making the sheets pivot.

If the distances between the fixing elements of the different sheets are the same, all sheets will have the same pattern of motion when being passed round a corner. It is then possible to adjust the distances in such manner that, for instance, they go clear of, for example, a balcony rail which is mounted just outside the lower rail. Since all the fixing elements are positioned in the same way on the sheets, a larger opening must usually be made in the rails, which for many of the existing constructions constitutes an insurmountable obstacle. In the inventive suspension device, however, this can be done since the ball castor is guided by a protruding edge of the section on the side of the centre line of the rail where the opening is positioned. Special smaller recesses can be made in the protruding edge to facilitate the insertion and removal of the castor.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
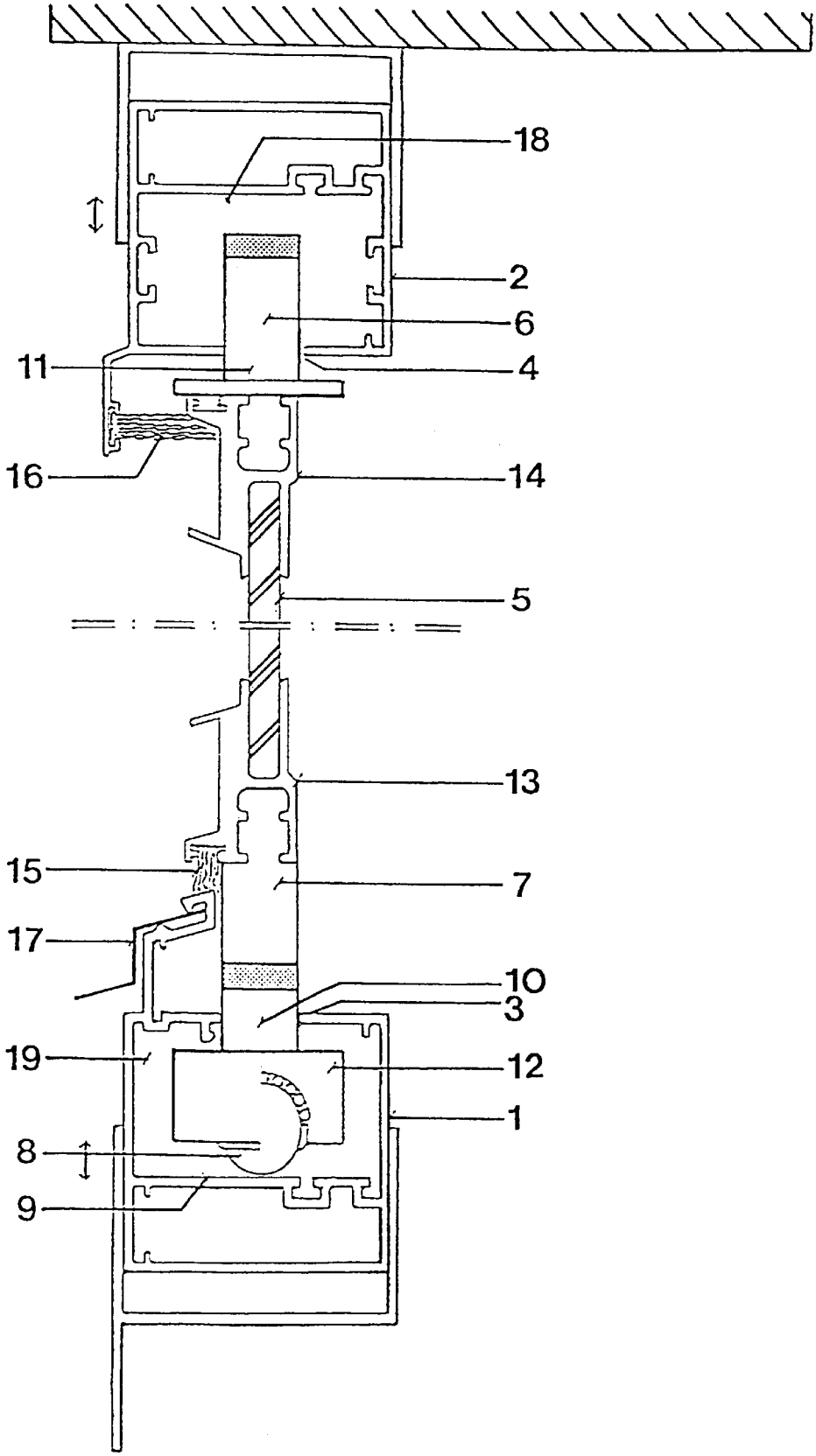
FIG. 1 is a sectional view transversely of the longitudinal direction of the rails, which schematically shows according to a preferred embodiment that part of the length of the rails in which the sheets are slidable.
Figure 2:
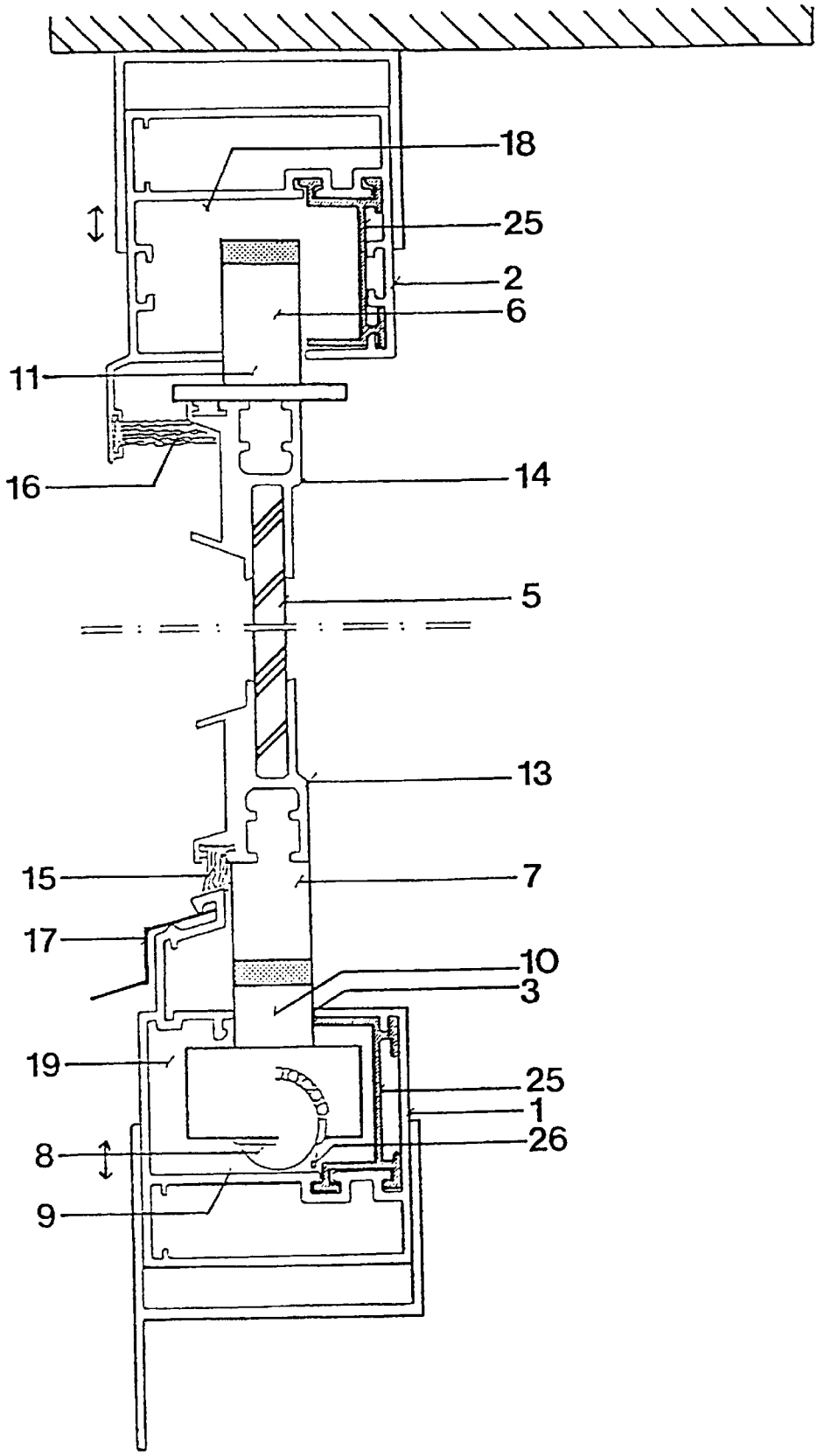
FIG. 2 is a sectional view transversely of the longitudinal direction of the rails, which schematically shows according to a preferred embodiment that part of the length of the rails in which the sheets are to be removed from he rails by turning.
Figure 3:
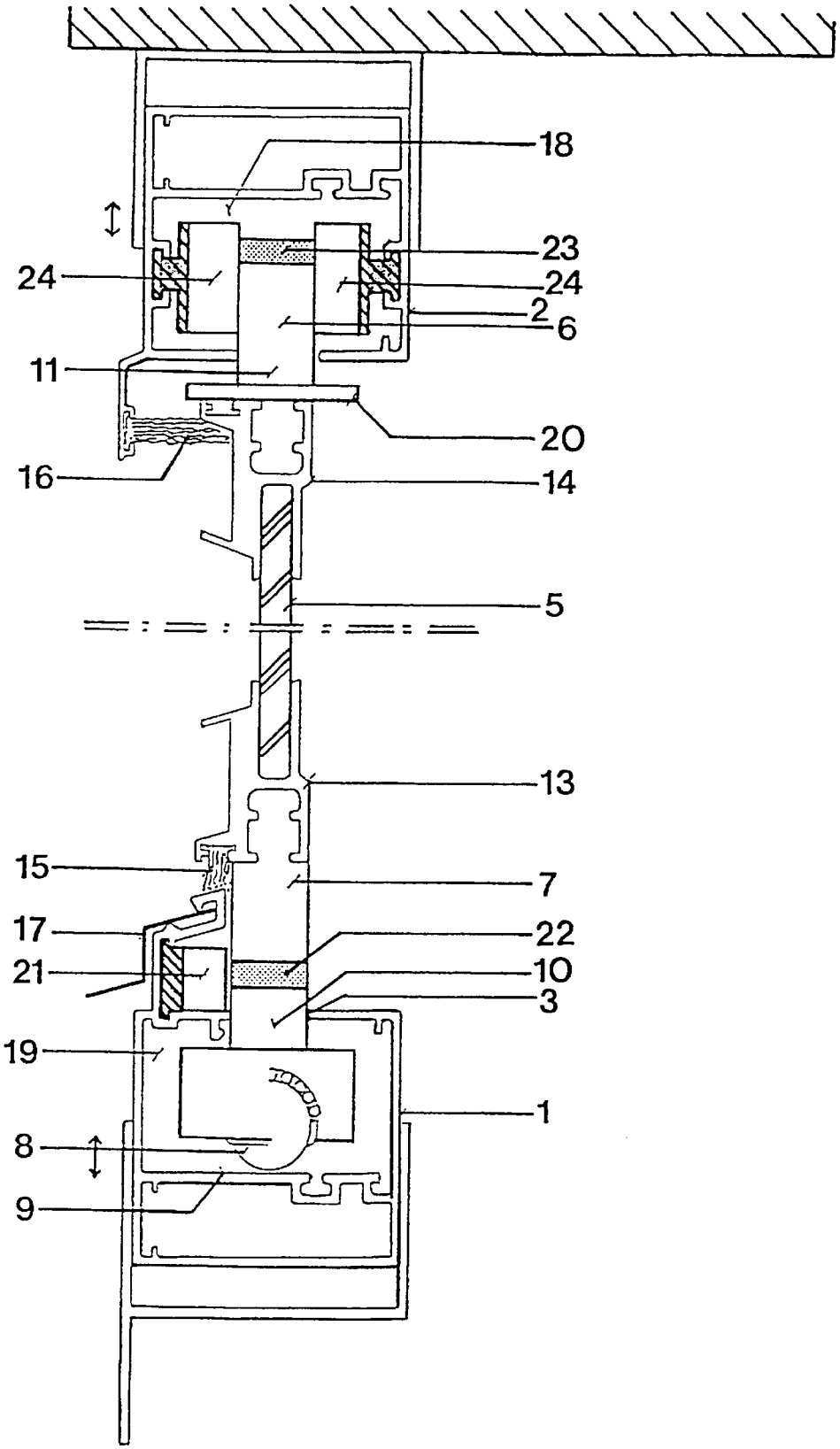
FIG. 3 is a sectional view transversely of the longitudinal direction of the rails, which schematically illustrates according to a preferred embodiment that part of the length of the rails in which the sheets are pivotally suspended from the rails.
Figure 4:
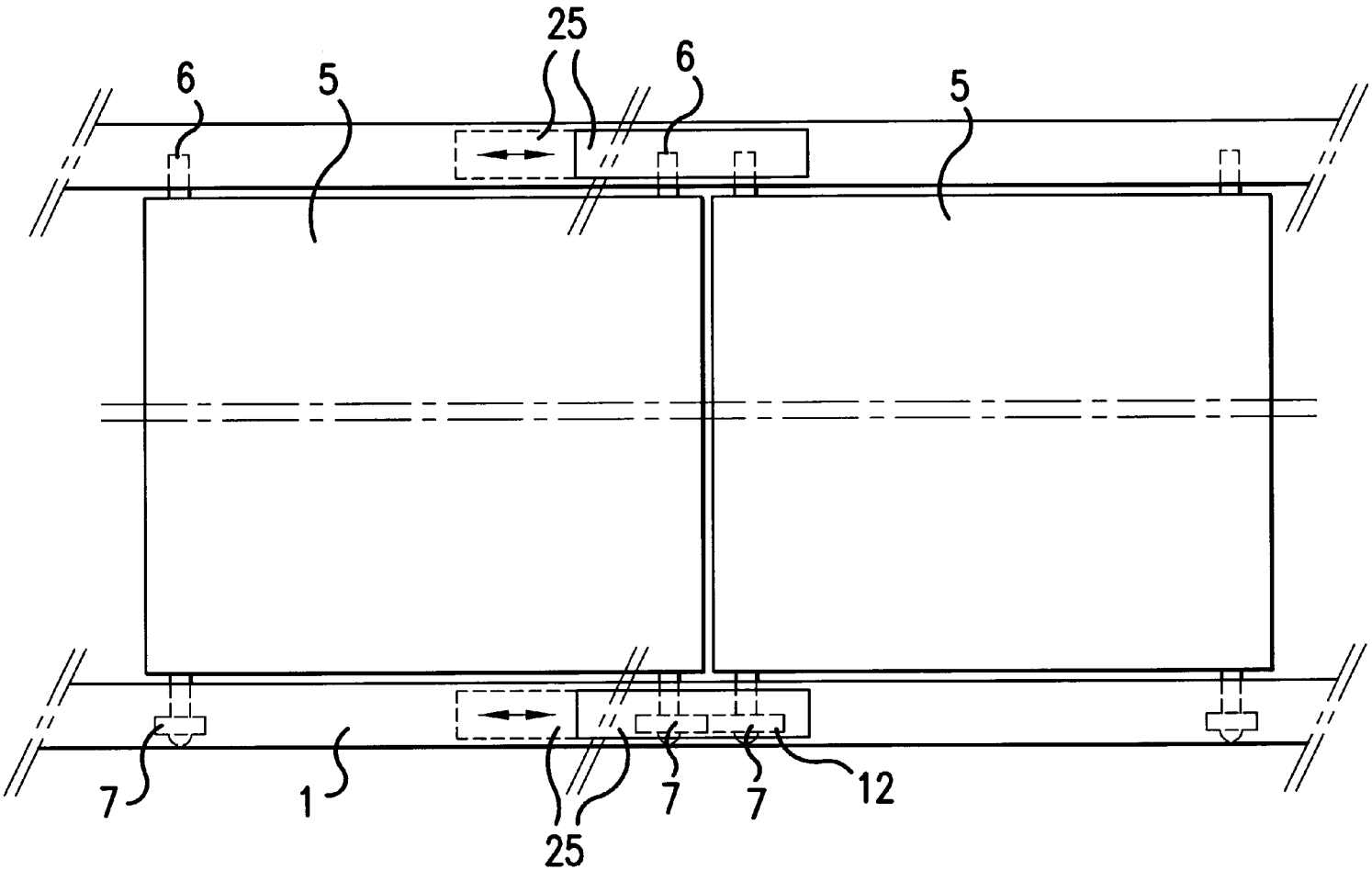
FIG. 4 is a side schematic view of the rails and sheets.

With reference to the Figures, two parallel rails 1, 2 are fixedly mounted one above the other. The two rails 1, 2 have a hollow square section with thin walls and a longitudinal slot 3, 4 on the side which is directed to the other rail. Each of the square sheets 5 is fixed to the rails 1, 2 by means of a fixing element 6, 7 in each corner. The lower fixing elements 7 have in their lower-most portion a ball castor 8 which carries the weight of the sheet 5. The ball castor 8 rests against a flat surface 9 inside the section of the lower rail 1. To guide the sheet 5 in the horizontal direction, each of the fixing elements 6, 7 has a cylindrical portion 10, 11 which extends through the slot 3, 4 in the rails 1, 2. Moreover there is formed on the lower fixing element 7 between the ball castor 8 and the cylindrical portion 10*a* portion 12, which has such a radial extent as to abut against the corresponding portion of the fixing element of a neighbouring sheet. As a result, each sheet 5 is automatically guided along the rails 1, 2 to the openable position. Correspondingly, a circular Part 20 is formed on the upper fixing element 6 to guide in the same way the relative positions of the sheets 5 along the rails 1, 2. With a view to preventing the sheets 5 from tilting by the upper fixing element 6 following the upper rail 2 when the sheet 5 is in an outwardly pivoted position, an insert 24 is arranged in the rail 2. The insert 24 has a longitudinal groove. In a predetermined spaced-apart relationship, holes 23 are arranged along the centre line of the grooves, said holes having a diameter (equal to the diameter of the portion 12 of the lower fixing element) which exceeds the width of the groove. By forming the upper fixing element 6 from a cylinder having the same diameter as said holes 23 and then making recesses on both sides to form a long and narrow pin of the same width as the groove and the same length as the diameter of the holes 23, the position of the sheet 5 can be locked in a hole 23 when making the sheet slide. To allow the sheets 5 to pivot through more than 90°, there is a special insert 21 in the rail 1, said insert in combination with a pin 22 arranged on the fixing element 7 (similar to the pin which enters the holes 23 at the upper fixing element) causing a lower guiding of the sheets. For the fixing of the sheets 5 to the fixing elements 6, 7, any conventional fastening device 13, 14 can be used. Use is advantageously made of seals 15, 16 and wind and water-repellent ledges 17 to prevent the interior 18, 19 of the sections and the fixing elements 6, 7 from being unnecessarily affected by wind and weather. To enable sliding of the sheets 5, recesses must be made in the sectional sides of the rails 1, 2. opening and closing is carried out by means of telescoping sections 25 which run in the longitudinal direction of the rails 1, 2 and which in the closed position are positioned in front of the openings and then also transmit horizontal forces from the sheets 5 to the rails 1, 2. Along the opening the ball castor 8 is guided by a protruding sectional part 26, in which small recesses are made to facilitate insertion and removal of the ball castor 8.

By arranging the fixing elements 6, 7 in the same positions on all sheets 5, they can be mounted on the inside of a balcony rail and still retain their possibility of being passed round corners since all the sheets 5 will obtain the same pattern of motion. Although this implies in many cases that larger recesses must be made in the side of the rail section 1, 2, this will not constitute a problem by using the above-mentioned telescoping sections 25 and the protruding sectional part 26.

The device according to the invention is primarily suited for suspending window-panes for balconies, glazed verandas or similar applications. However, the construction does not leave out the possibility of using it as a ceiling in different angles. For instance, the inventive device can be used as partitions for rooms, the size of which should be variable. The simplicity and robustness of the construction make it suitable for many different applications.

The invention is not limited to the embodiment illustrated in the drawings and described above and variations are feasible within the scope of the invention. Thus, additional flexibility can be obtained by giving the rails and the lateral sections a telescoping function, for instance by fixing a larger section in the surroundings and then placing the section which is to contact the sheet in the larger section and fixing it in the correct position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for pivotable and slidable suspension of sheets, said device comprising:

an upper and a lower rail, which are arranged in parallel with each other and which each have, transversely of their longitudinal direction, a hollow section with a longitudinal slot defined by inwardly projecting flanges on the side facing the other rail, and a pair of upper and a pair of lower fixing elements on each of the sheets, said fixing elements being, via the slots, in horizontal engagement with the rails, the lower fixing elements having in their lower-most portion a spherical part which rests against a planar sliding surface in the section of the lower rail wherein both the lower and the upper fixing elements prevent any vertical engagement between the fixing elements and the rails in the area of the slots and allow relative vertical motion between the rails and fixing elements having elongated cylindrical portions extending in the vertical direction through the slot in each rail, the cylindrical portions extending in the vertical direction allowing relative vertical motion between said upper and lower rails and said upper and lower fixing elements respectively, and the diameters of the cylindrical portions being slightly smaller than the width of each slot to absorb horizontal forces in the contact area between the cylindrical portions and the flanges defining the slots, wherein said rail sections at predefined opening positions have opening apertures on at least one vertical side of the rails for passage of one first vertical pair of upper and lower fixing elements when opening the sheets, said aperture being closable by a telescoping section which in a closed position transmits horizontal forces from the sheets to the fixing elements, and means for locking of a second vertical pair of upper and lower fixing elements in a position along the rail when pivoting the sheet around said second pair of fixing elements during opening of the sheets.

2. The suspension device as claimed in claim 1, wherein the spherical part of the lower fixing element is a ball castor.

3. The suspension device as claimed in claim 1, wherein the lower fixing element in a portion between the cylindrical portion and the spherical part has a radial extent and is adapted to abut against the corresponding portion of a neighboring sheet, thereby guiding the relative position of the sheets along the rails.

4. The suspension device as claimed in claim 1, wherein the upper fixing element has a portion of elongate cross-section, which is oriented along the rail when the sheet is in the slidable position, and which is arranged to be turned and locked in an expansion of the rail with which it engages when the sheet has been pivoted, thereby locking the sheet in a position along the rail.

5. The suspension device as claimed in claim 1, wherein the lower fixing element has a portion of elongate cross-section, which is oriented along the rail when the sheet is in the slidable position, and which elongate cross-section is arranged to be turned and locked in an expansion of the rail with which it engages when the sheet has been pivoted, thereby locking the sheet in a position along the rail, which permits guiding in the lower edge of the sheet also for angles of aperture exceeding 90°.

6. The suspension device as claimed in claim 1, wherein the distance between the fixing elements on each of the sheets in the direction along each rail is the same for all the sheets.

7. The suspension device as claimed in claim 1, wherein the upper fixing element has a circular part which is arranged to abut against the corresponding part of a neighboring sheet, thereby guiding the relative position of the sheets along the rails.

8. The suspension device as claimed in claim 1, wherein openings formed in the rail sections to permit pivoting of the sheets, are openable and closable by a telescoping section which in a closed position transmits horizontal forces from the sheets to the rails.

9. The suspension device as claimed in claim 1, wherein the device is for sheets of window-panes for glazed verandas or balconies.

10. The suspension device as claimed in claim 1, where the fixing elements are arranged in each corner of the sheet.

11. A sliding element system for pivotable and slidable suspension of sheets, such as window-panes for glazed verandas or balconies, comprising sheets each having a pair of upper and a pair of lower fixing elements;

parallell upper and lower rails, each of said rails having a hollow section and a longitudinal slot defined by opposite, inwardly projecting flanges on a side facing the other rail for horizontal engagement with the upper and the lower fixing elements, wherein said rail sections at predefined opening positions have opening apertures on at least one vertical side of the rails for passage of one first vertical pair of upper and lower fixing elements when opening the sheets, said aperture being closable by a telescoping section which in a closed position transmits horizontal forces from the sheets to the fixing elements, and locking means for horizontal locking of a second vertical pair of upper and lower fixing elements when pivoting the sheet around said second pair of fixing elements during opening of the sheets; wherein the lower fixing element of at least the second vertical pair of fixing elements in its lower-most portion has a spherical part which rests against a planar sliding surface inside the lower rail providing a support for the sheet in the vertical direction and enabling both sliding and pivoting motions, the lower and the upper fixing elements are elongated and cylindrical in the portion extending through the slots in order of allowing relative vertical motion between the rails and the fixing element for preventing any vertical engagement between the fixing elements and the rails in the area of the slots; and the diameters of the elongated, cylindrical portions being slightly smaller than the width of the slots in order of providing a lateral support of the sheet and absorbing horizontal forces in the contact area between the cylindrical portions and the flanges defining the slots.

12. The system according to claim 11, wherein the spherical part of the lower fixing element is a ball castor.

13. The system according to claim 11, wherein the lower fixing element in a portion between the cylindrical portion and the spherical part has a radial extent and is adapted to abut against the corresponding portion of a neighbouring sheet, thereby guiding the relative position of the sheets along the rails.

14. The system according to claim 11, wherein the upper fixing element has a portion of elongate cross-section, which is oriented along the rail when the sheet is in the slidable position, and which is arranged to be turned and locked in an expansion of the rail with which it engages when the sheet has been pivoted, thereby locking the sheet in a position along the rail.

15. The system according to claim 11, wherein the lower fixing element has a portion of elongate cross-section, which is oriented along the rail when the sheet is in the slidable position, and which elongate cross-section is arranged to be turned and locked in an expansion of the rail with which it engages when the sheet has been pivoted, thereby locking the sheet in a position along the rail, which permits guiding in the lower edge of the sheet also for angles of aperture exceeding 90°.

16. The system according to claim 11, wherein the distance between, the fixing elements on each of the sheets in the direction along each rail is the same for all the sheets.

17. The system according to claim 11, wherein the upper fixing element has a circular part which is arranged to abut against the corresponding part of a neighboring sheet, thereby guiding the relative position of the sheets along the rails.

18. The system according to claim 11, wherein apertures are formed in the rail sections to permit pivoting of the sheets, are openable and closable by a telescoping section which in a closed position transmits horizontal forces from the sheets to the rails.

19. The system according to claim 18, wherein the second pair of upper and lower fixing elements is prevented from horizontal movements while pivoting the sheet.

* * * * *